US007721786B2

(12) United States Patent
Numano et al.

(10) Patent No.: US 7,721,786 B2
(45) Date of Patent: May 25, 2010

(54) CASTING NOZZLE

(75) Inventors: Masatada Numano, Osaka (JP); Yoshihiro Nakai, Osaka (JP); Toshiya Ikeda, Osaka (JP); Mitsuyuki Kobayashi, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/579,442

(22) PCT Filed: Jun. 27, 2005

(86) PCT No.: PCT/JP2005/011707

§ 371 (c)(1),
(2), (4) Date: May 15, 2006

(87) PCT Pub. No.: WO2006/003855

PCT Pub. Date: Jan. 12, 2006

(65) Prior Publication Data

US 2007/0095500 A1 May 3, 2007

(30) Foreign Application Priority Data

Jun. 30, 2004 (JP) ..... 2004-194845

(51) Int. Cl.
*B22D 11/10* (2006.01)
*B22D 11/06* (2006.01)

(52) U.S. Cl. ..... 164/437; 164/428

(58) Field of Classification Search ..... 164/437, 164/428, 480

See application file for complete search history.

(56) References Cited

U.S. PATENT DOCUMENTS 5,697,425 A * 12/1997 Nanba et al. ..... 164/468

(Continued)

FOREIGN PATENT DOCUMENTS

EP 0 040 073 A1 11/1981

(Continued)

OTHER PUBLICATIONS

International Preliminary Report on Patentability and Written Opinion issued in International Application No. PCT/JP2005/011707, dated Jan. 18, 2007.

(Continued)

*Primary Examiner*—Kevin P Kerns
(74) *Attorney, Agent, or Firm*—McDermott Will & Emery LLP

(57) ABSTRACT

A casting nozzle for supplying a molten alloy liquid of aluminum alloy or magnesium alloy to a movable mold for continuous casting from a tundish, in which the molten alloy liquid is stored. The casting nozzle is fixed to the tundish. The casting nozzle tip arranged on the movable mold side is made of a highly heat-conductive material having a heat conductivity of 0.2 W/mK or more, and a highly elastic material having an elastic modulus of 5000 MPa or more, etc. By making the tip of the casting nozzle with a material having superior thermal conductivity, the irregularity in solidification of the molten alloy liquid is decreased and thereby the surface quality of a cast alloy is improved. The nozzle tip is formed with a material having high elasticity and superior elastic deformability, whereby the interstice between the movable mold and the tip of outer peripheral edge of the nozzle is narrowed, and accordingly a cast alloy having superior surface quality can be obtained.

6 Claims, 3 Drawing Sheets

U.S. PATENT DOCUMENTS

| | | | | |
|---|---|---|---|---|
| 5,912,080 | A * | 6/1999 | Fiel et al. | 428/408 |
| 6,173,755 | B1 * | 1/2001 | Li et al. | 164/429 |

FOREIGN PATENT DOCUMENTS

| | | | |
|---|---|---|---|
| GB | 2 273 068 | A | 6/1994 |
| JP | 53-76954 | A | 7/1978 |
| JP | 57-137057 | | 2/1981 |
| JP | 60-12263 | | 1/1985 |
| JP | 60-126256 | U | 8/1985 |
| JP | 60-216955 | | 10/1985 |
| JP | 63-43748 | | 2/1988 |
| JP | 63-101053 | | 5/1988 |
| JP | 04-032541 | | 2/1992 |
| JP | 05-104217 | | 4/1993 |
| JP | 5-318040 | A * | 12/1993 |
| JP | 09-201653 | | 8/1997 |
| JP | 11-5146 | A | 1/1999 |
| JP | 2000-117402 | | 4/2000 |
| WO | WO 2004/020126 | A1 | 3/2004 |

OTHER PUBLICATIONS

Supplementary European Search Report issued in corresponding European patent application No. EP 05 76 5081 dated Feb. 22, 2007.

United States Office Action issued in U.S. Appl. No. 12/198,387 dated Oct. 1, 2009.

Japanese Notification of Reasons for Rejection, w/ English translation thereof, issued in Japanese Patent Application No. JP 2004-194845 dated Nov. 30, 2009.

Japanese Notification of Reasons for Rejection, w/ English translation thereof, issued in Japanese Patent Application No. JP 2004-194845 dated Feb. 23, 2010.

* cited by examiner

CASTING NOZZLE

RELATED APPLICATIONS

This application is the U.S. National Phase under 35 U.S.C. §371 of International Application No. PCT/JP2005/011707, filed on Jun. 27, 2005, which in turn claims the benefit of Japanese Application No. 2004-194845, filed on Jun. 30, 2004, the disclosures of which Applications are incorporated by reference herein.

TECHNICAL FIELD

The present invention relates to a casting nozzle which is suitable for use in casting aluminum alloy or magnesium alloy continuously, and to a casting method, in which the casting nozzle is used, for producing a cast alloy. The invention also relates to a cast alloy manufactured by the casting method. Particularly, the invention relates to a casting nozzle which is most suitable for manufacturing a cast alloy having excellent surface quality.

BACKGROUND ART

In known continuous casting methods in the past, molten metal is continuously supplied into a movable mold, which is made of rolls, belts, etc., and the molten metal is solidified by cooling in the movable mold so that a cast alloy can be produced continuously. The molten metal is supplied to the movable mold through a nozzle. Such nozzles are described in the patent documents 1-3, for example. The nozzles described in the patent document 1 and 2 are provided with a felt layer consisting of ceramic fibers at the tip of the casting nozzle which touches a movable mold. In the patent document 3, a nozzle made of alumina-graphite materials is described.

[Patent document 1] Japanese Patent Application Laid-Open No. S 63-101053;

[Patent document 2] Japanese Patent Application Publication No. H 5-318040;

[Patent document 3] Japanese Patent Application Publication No. H 11-5146.

DISCLOSURE OF THE INVENTION

Problems to be Solved by the Invention

Materials used for forming a casting nozzle used for continuous casting are ceramics such as silica (silicon oxide ($SiO_2$)) and alumina (aluminum oxide ($Al_2O_3$)) which are superior in heat resistance and heat retention properties, etc. However, with a nozzle consisting of such a ceramic material, it is difficult to further improve surface quality of a cast alloy to be manufactured. Particularly, recently, the quality level that is required of magnesium alloy products has become higher with the expansion of application fields in which magnesium alloy products are used, and the demand for improvement in the quality of products appearance as well as improvement in light weight and corrosion-resistance has increased. However, with the conventional nozzles described above, it is difficult to satisfy such requirements sufficiently, particularly with respect to the quality of products appearance.

Therefore, the main object of the present invention is to provide a casting nozzle most suitable for producing a cast alloy having superior surface quality. Also, it is another object of the present invention to provide a manufacturing method using the casting nozzle for manufacturing cast alloys, and to provide cast alloys manufactured by the manufacturing method.

Means for Solving the Problems to be Solved

As a result of investigation by the present inventors, it was found that the causes of surface quality degradation are lack of uniformity in solidification of a material in the width direction during casting and existence of a large interstice between the tip of the outer peripheral edge of a nozzle and a movable mold. Based on this knowledge, the present invention aims to improve the surface quality by specifying the material of the tip of the nozzle.

More specifically, in order to perform the solidification of molten alloy liquid uniformly in the width direction of the material, it is proposed to use a material that is superior in terms of thermal conductivity. That is, one embodiment of the present invention is a casting nozzle which is fixed to a tundish for storing molten aluminum alloy liquid or magnesium alloy liquid and which supplies the molten alloy liquid from the tundish to a movable mold for continuous casting. The nozzle tip which is arranged on the movable mold side has a highly heat-conductive layer made of a material having a heat conductivity layer equal to or more than 0.2 W/mK.

With a nozzle made of a ceramic material which is heat-resistant, depending on the composition of a metal which is subjected to continuous casting, the temperature of molten alloy liquid varies in a direction of cross-sectional width of the tip of the nozzle arranged on the movable mold side, and accordingly solidification in a cross-sectional width direction of the material is varied, which occasionally results in occurrence of a longitudinal crack. Consequently, a cast alloy thus obtained must be subjected to surface processing such as machining. Therefore, in the case of a casting nozzle made of a ceramic material, it has been desired to expand a narrow scope of metal composition that enables superior surface quality of a cast alloy.

In contrast, with a casting nozzle in which at least the tip of the nozzle, which is the casting point, is made of a material having superior thermal conductivity, heat conduction to molten alloy liquid can be accomplished uniformly in a cross-sectional width direction of the nozzle. Consequently, the molten alloy liquid supplied to a movable mold from the tip of the nozzle can result in a cast alloy in which the occurrence of longitudinal crack is decreased and which has superior surface quality, because uniform solidification is made possible due to small temperature variation in a cross-sectional width direction of the nozzle. Therefore, the present invention prescribes that a highly heat-conductive layer be provided at the tip of a nozzle.

Also, the invention proposes to use a material superior in terms of strength and elastic deformability in order to decrease an interstice between a movable mold and the tip of the outer peripheral edge of a nozzle. That is, one aspect of the present invention is a casting nozzle which is fixed to a tundish for storing a molten liquid of melt aluminum alloy or magnesium alloy and which supplies the molten alloy liquid from the tundish to a movable mold for continuous casting. According to one embodiment of the invention, the casting nozzle has, at the tip thereof which is arranged on the movable mold side, a high strength elastic layer made of a material having an elastic modulus of 5000 MPa or more and a tensile strength of 10 MPa or more.

If the nozzle made of ceramic fibers which is described in the patent documents 1 and 2 is arranged in a manner where the tip of outer peripheral edge of the nozzle touches a movable mold, in some cases, the nozzle wears during casting since its strength is comparatively low, although its heat resistance properties are superior, and a gap occurs between the tip and the movable mold, and consequently molten alloy liquid leaks out from the gap: that is, so-called molten liquid leakage has occasionally occurred. Therefore, prior to casting, an arrangement was done such that the interstice between the movable mold and the tip of outer peripheral edge of the nozzle might become as narrowest as possible. However, in order to prevent the molten liquid leakage, it is desirable to make the arrangement prior to casting such that the tip of outer peripheral edge of the nozzle is in contact with the movable mold as much as possible.

Also, in the technology described in the patent documents 1 and 2, a movable mold comprising one roll is used. In such movable mold of single-roll type, there are no cases where the position of the roll changes during casting because of the power to receive from the material which is cast. Therefore, there seldom occurs a case where the interstice which is fixed prior to casting between the movable mold and the tip of outer peripheral edge of the nozzle changes during casting is done. On the other hand, in a movable mold comprising one pair of rolls, there occurs a case where a gap between the rolls opens due to reaction force when the solidified material is subjected to draft between the rolls during casting, even if adjustment has been done prior to casting so that the gap between the rolls, particularly the gap when both rolls approach most (i.e., the minimum gap), may be constant. Therefore, even if the nozzle is arranged prior to casting such that the interstice between the movable mold and the tip of outer peripheral edge of the nozzle becomes as small as possible, occasionally the gap becomes wider during casting because the gap between the rolls opens due to the above-mentioned reaction force. More specifically, in some cases the gap became 0.8 mm or more, thereby causing leakage of molten liquid.

In consideration of the above-described situation, particularly in a case where a movable mold comprising one pair of rolls was used in the past, it was attempted to prevent molten liquid from leaking out through an interstice between the movable mold and the tip of outer peripheral edge of the nozzle, by increasing the casting speed to a given speed or faster, or by adjusting the flow rate of molten alloy liquid so that meniscus (molten alloy liquid surface which is formed in a region to the part where the molten alloy liquid which flows from the tip of the nozzle first touches a movable mold) might become larger. However, a longitudinal crack was easily generated as a result of increasing the casting speed, or the size of a ripple mark tended to become larger as a result of increasing the meniscus, which resulted in the cause of degradation of surface quality.

In contrast, a nozzle in which at least the nozzle tip to be used as a casting point is made of a material having superior strength does not wear easily during casting even if the nozzle is arranged in a manner such that the tip of the nozzle touches a movable mold prior to casting. And, the nozzle, in which at least the nozzle tip as a casting point is formed of a material having superior elastic deformability, can be arranged in a manner in which the nozzle tip is pressed to the movable mold prior to casting. Also, even if the movable mold moves such that the gap between the rolls spreads or the like, the nozzle can follow such movement, thereby maintaining for a long time the condition which was arranged prior to casting. Thus, a nozzle made of a material having high strength and superior elastic deformability can be arranged prior to casting in a manner such that the interstice between the movable mold and the tip of outer peripheral edge of the nozzle is as smallest as possible, and particularly the tip can be arranged so as to touch the movable mold. That is, the interstice between the tip of outer peripheral edge of the nozzle and the movable mold can be substantially eliminated.

Moreover, even in the case of a movable mold consisting of one pair of rolls, it is made possible to follow the movement of rolls to some degree by elastic deformation, and accordingly the interstice between the tip of outer peripheral edge of the nozzle and the movable mold does not spread easily during casting. Therefore, even if the casting speed is made slower than in the past, or the meniscus is made smaller, the molten liquid leakage can be prevented while the casting speed and the meniscus can be decreased. Consequently, it is possible to obtain a cast alloy having superior surface quality by restraining the occurrence of a longitudinal crack and the enlargement of a ripple mark, thereby reducing the deterioration of the surface quality. Therefore, the present invention defines that a high strength elastic layer is provided at the tip of a nozzle.

Hereinafter, the present invention is described in detail.

The heat conductivity of a material having superior thermal conductivity is designed to be equal to or more than 0.2 W/mK so that variation in the temperature of molten alloy liquid may be suppressed to a small amount in a cross-sectional width direction of a nozzle. With a heat conductivity less than 0.2 W/mK, there is only a small effect of conducting heat uniformly in the cross-sectional width direction of the nozzle. More preferably, the heat conductivity is 5 W/mK or more. Particularly, at least the tip of the nozzle arranged on the movable mold side is equipped with a highly heat-conductive layer made of the above-mentioned material having superior thermal conductivity so that variation in temperature in the cross-sectional width direction of the molten alloy liquid is suppressed when the molten alloy liquid touches the movable mold. In particular, it is preferable to provide the highly heat-conductive layer on the inner circumference which touches molten alloy liquid. The entire nozzle may be made of the material having superior thermal conductivity. The examples of materials having such superior thermal conductivity include materials of carbon system such as carbon, or carbon-carbon composite (C/C composite: compound material which is made of carbon as a matrix and carbon fibers as a reinforcing material), and metallic materials such as iron, nickel, titanium, tungsten, molybdenum, and alloys including of these metals 50% by mass or more. The alloys which contain iron are, for example, steel, stainless steel, etc. Also, the highly heat-conductive layer comprising such material has the above-mentioned heat characteristics even if it is a thin layer of less than 3.0 mm. Practically, the preferable thickness is equal to or more than 0.1 mm.

Here, in the case of metallic materials, the thermal conductivity can be read as electrical conductivity. That is, materials having superior electrical conductivity can also be used instead of materials having superior thermal conductivity. In this case, a suitable electrical conductivity is 5% or more according to International Annealed Copper Standard (IACS). Particularly, 10% IACS or more is preferable. The examples of metallic materials having such superior conductivity include iron, nickel, titanium, tungsten, molybdenum, and alloys containing these metals 50% by mass or more.

The material which is superior in terms of strength and elasticity is designed to have strength sufficient to prevent wear even if it touches a movable mold, and to have a tensile strength of 10 MPa or more and an elastic modulus of 5000 MPa or more so that it may have deformability which is sufficient to make close contact with the movable mold and to follow the movement of the movable mold. At least the nozzle tip arranged on the movable mold side is provided with a high-strength elastic layer made of a material having such superior elasticity and high strength. The entire nozzle may be formed of such material having high strength and high elasticity. Then, since the nozzle has superior elasticity, it is possible to arrange the nozzle in the state in which, prior to casting, the tip of the nozzle is pressed to the movable mold, thereby deforming it within an elastically deformable range such that it is in close contact with the movable mold. Also, since the nozzle is superior in terms of elasticity, it can follow the movement of the movable mold during casting: for example, in the case of a movable mold consisting of one pair of rolls, it can follow such a movement as the gap between the rolls spreads. Thus, without adding a force, such as a pressing force from outside, to the nozzle in order to maintain the interstice between the tip of outer peripheral edge of the nozzle and the movable mold to be small, the narrow gap can be maintained for a long period. More specifically, the gap can be maintained within 0.8 mm or less.

Moreover, as described above, even if the nozzle is arranged in close contact with the movable mold prior to casting, the nozzle does not wear easily because of its superior strength, and consequently the interstice between the tip of outer peripheral edge of the nozzle and the movable mold can be kept small for a long time. Also, the miniaturization of the nozzle and the lessening in the thickness thereof can be achieved because it is superior in terms of strength. More specifically, the thickness of the tip of the nozzle can be designed to be less than 3.0 mm. By making the tip of the nozzle in such thin thickness, it is possible to decrease the region surrounded with the tip of the nozzle, the prolongation of the tip of the edge of internal circumference of the nozzle, and the movable mold when the tip of outer peripheral edge of the nozzle is caused to touch a movable mold. Accordingly, the meniscus, which is formed when molten alloy liquid is supplied to the movable mold, can be made small. Consequently, the enlargement of a ripple mark can be restrained. The thinner the thickness of the tip of the nozzle, the smaller the meniscus can be made by decreasing the above-mentioned region, and from the viewpoint of practical use, the suitable thickness is about 0.5-2.0 mm.

In the case of tensile strength less than 10 MPa, when a nozzle is arranged in a manner in which the tip of the nozzle is in contact with the movable mold, the nozzle easily wears because of the weak strength, and also it is difficult to downsize the nozzle or to lessen the thickness thereof. In addition, if the elastic modulus is less than 5000 MPa, it is difficult to accomplish the elastic deformation even if the tip of the nozzle is arranged in a manner in which it is pressed to the movable mold, and it is difficult to make it to be in close contact with the movable mold and to follow the movement of the movable mold during casting. More preferably, the tensile strength is equal to or more than 20 MPa, and the elastic modulus is equal to or more than 7000 MPa.

The examples of materials having such superior strength and elasticity include materials of carbon system such as carbon, C/C composite, etc. and metallic materials such as iron, nickel, titanium, tungsten, molybdenum, and alloys containing these metals 50% by mass or more, for example, stainless steel. If at least the tip of the nozzle is made of such material, it is possible to make the molten alloy liquid to have a uniform temperature in the cross-sectional width direction of the nozzle and to maintain the narrowness of the interstice between the tip of outer peripheral edge of the nozzle and the movable mold. Consequently, it is possible to stably obtain cast alloys having superior surface quality. The density of oxygen contained in these materials is low as compared with oxide materials such as alumina and silica. Therefore, particularly when a magnesium alloy is made by continuous casting, it is possible to reduce the degradation of surface quality caused by magnesium combining with oxygen. Since magnesium is a very active metal, the magnesium which is the main ingredient of the molten alloy liquid occasionally happens to combine with oxygen in the above-mentioned oxide material and reduces the material during casting. In such case, as a result of the nozzle being deprived of oxygen by magnesium, the nozzle may be damaged, whereby the heat retention properties of the molten alloy liquid may deteriorate, which may result in irregularity of solidification in a cross-sectional width direction of the material. Also, the magnesium oxide formed by the combination with oxygen may cause irregular solidification when it is mixed into molten alloy liquid since the magnesium oxide does not dissolve again. Such irregular solidification deteriorates the surface quality of a cast alloy. However, the deterioration of surface quality due to combination of magnesium and oxygen can be reduced by using a material containing such small quantity of oxygen as mentioned above.

Also, the tip of a nozzle according to the present invention may have a high density layer made of a material having a bulk density of 0.7 g/cm3 or more. In the case of a material having a bulk density of 0.7 g/cm3 or less, the thermal conductivity becomes inferior and the strength is decreased because of high void ratio, and consequently the tip of the nozzle is transformed by the dead weight in a cross-sectional width direction, and accordingly, a gap is generated between the tip of the nozzle and the movable mold, which results in a cause of the molten liquid leakage. Therefore, by providing the tip of the nozzle with a high density layer having a bulk density exceeding 0.7 g/cm3, the thermal conductivity and the strength can be improved. More preferably, the bulk density is equal to or more than 1.0 g/cm3. The examples of such materials include materials of carbon system such as carbon, C/C composite, etc. and metallic materials such as iron, nickel, titanium, tungsten, molybdenum, and alloys containing these metals equal to or more than 50% by mass, for example, stainless steel. That is, the layer consisting of these materials is superior in terms of thermal conductivity and elastic deformability, and has high density as well as high strength.

The nozzle of the present invention may have a structure in which the tip is formed in a multilayer including a plurality of layers consisting of different materials using the above-mentioned materials having superior thermal conductivity, materials having high strength and high elasticity, and materials of high density. For example, it may have a bilayer structure consisting of a carbon layer and a molybdenum layer. In this case, the carbon layer and the molybdenum layer both function as the superior thermal conductivity layer, the high strength layer, the highly elastic layer, and the high density layer. Besides, it may be equipped with a layer consisting of a material of low thermal conductivity, such as a ceramic fiber sheet, in addition to the layers consisting of the above-mentioned materials having various superior characteristics. For example, the nozzle may be provided with such a layer made of a material having low thermal conductivity at the internal circumference side thereof which touches molten alloy liquid. This makes it possible to obtain the effect of conducting heat uniformly in a cross-sectional width direction of the nozzle by providing the above-mentioned highly heat-conductive layer together with the above-mentioned low-thermal-conductivity layer.

When the tip of a nozzle made of a material having superior thermal conductivity touches a roll, it occasionally happens that the heat of the molten alloy liquid is conducted to the roll through the nozzle, and the molten alloy solidifies before the molten alloy liquid touches the roll. In order to reduce such shortcoming, it is preferable that at least one layer of low thermal conductivity such as a ceramic fiber sheet be provided between the roll and the molten alloy liquid.

Such a casting nozzle of the present invention is suitable for use in the continuous casting of metals such as aluminum alloy and magnesium alloy. More specifically, it is used as a member which supplies molten alloy liquid to a movable mold from a tundish in a continuous casting system. An example of composition of the continuous casting system comprises a melting furnace for dissolving metal into molten alloy liquid, a tundish for temporarily storing the molten alloy liquid supplied from the melting furnace, a transfer gutter arranged between the melting furnace and the tundish, and a movable mold for casting the molten alloy liquid supplied from the tundish. The nozzle of the present invention may be arranged in a manner in which one end thereof is fixed to the tundish, with the other end (tip) being disposed in contact with the movable mold. Besides, in order to more effectively prevent molten alloy liquid from leaking out from an interstice between the tip of outer peripheral edge of the nozzle and the movable mold, a molten liquid dam (side dam) may be provided at the vicinity of the tip of the nozzle.

The melting furnace has a structure comprising, for example, a crucible for storing molten alloy liquid and a heating means which is arranged at the outer periphery of the crucible and used for dissolving metal. Preferably, a heating means for maintaining the temperature of molten alloy liquid is provided at the outer peripheries of the transfer gutter and the nozzle. The movable mold comprises, for example, (1) one pair of rolls as represented by a twin-roll process (twin roll method), (2) one pair of belts as represented by a twin-belt process (twin belt method), or (3) a combination of a plurality of rolls (wheels) and a belt as represented by a wheel-belt method (belt & wheel method).

In these movable molds using a roll and a belt, a smooth and flat condition of the surface of a cast alloy can be easily maintained because the temperature of the mold can easily be maintained constant and because the surface which touches molten alloy liquid appears continuously. Particularly, the movable mold in which one pair of rolls that turn in mutually opposite directions are arranged at opposing positions is preferable, that is, the above-mentioned structure (1) is preferable, because the mold is made with high precision and also it is easy to maintain a constant position of the mold surface (surface which touches molten alloy liquid). Likewise, since the mold is structured such that the surface which touches molten alloy liquid appears continuously according to the rotation of a roll, it is possible to apply a mold-releasing agent or to remove adhering substances efficiently during a period in which the surface that has once been used for casting touches the molten alloy liquid again, and also it is possible to simplify equipment for performing such coating or removal work.

The term aluminum alloy as defined in the present invention includes not only a pure aluminum alloy which consists of aluminum and impurities, but also an alloy which contains aluminum and an alloying element (i.e., an alloy consisting of aluminum, an alloying element, and impurities). For example, aluminum which contains an alloying element may be selected from JIS 1000-series-7000-series; that is, the present invention can be used for casting aluminum of 5000-series, 6000-series, etc. Also, the term magnesium alloy as defined in the present invention includes a pure magnesium which consists of magnesium and impurities as well as an alloy which consists of magnesium and an alloying element (an alloy consisting of an alloying element, magnesium, and impurities). The present invention can be used for the continuous casting of magnesium that contains an alloying element, for example, AZ-series, AS-series, AM-series, or ZK-series of ASTM standard. Besides, it can be utilized for the continuous casting of a composite material which consists of aluminum alloy and carbide, the composite material which consists of aluminum alloy and oxide, a composite material which consists of magnesium alloy and carbide, a composite material which consists of magnesium alloy and oxide.

By performing continuous casting using a nozzle the present invention, practically infinitely long cast alloy can be obtained. Particularly, using the nozzle of the present invention makes it possible to effectively prevent the molten liquid leakage and to obtain a cast alloy which is superior in terms of surface quality.

Advantageous Effect of the Invention

As described hereinabove, in the case where continuous casting is performed using a casting nozzle of the present invention, it is possible to obtain a cast alloy which is superior in terms of surface quality, particularly because the nozzle tip arranged on the movable mold side has superior thermal conductivity, which results in decrease of deviation in the temperature of molten alloy liquid in a cross-sectional width direction, thereby enabling uniform solidification. Likewise, when continuous casting is performed using a casting nozzle of the present invention, particularly because the nozzle tip arranged on the movable mold side has high strength and superior elastic deformability, the nozzle tip can be arranged so as to touch, or to be in close contact with, a movable mold prior to casting, whereby the interstice between the tip of outer peripheral edge of the nozzle and the movable mold can be decreased. Thus, even if the movable mold moves during casting, the interstice between the tip of outer peripheral edge of the nozzle and the movable mold can be maintained small, following such movement. Therefore, it is possible to prevent the occurrence of molten liquid leakage and to make the casting speed comparatively slow so as to prevent an easy occurrence of longitudinal crack; thus, it is possible to reduce the degradation of the surface quality by decreasing the size of meniscus and restraining the enlargement of a ripple mark. Accordingly, a cast alloy having superior surface quality can be obtained by using a casting nozzle of the present invention in continuous casting.

BRIEF DESCRIPTION OF THE DRAWINGS

FIG. 3(A) shows an example used in the examination example 2.

FIG. 3(B) shows an example used in the examination example 3.

FIG. 3(C) shows an example used in the examination example 4.

BEST MODE FOR CARRYING OUT THE INVENTION

Hereinafter, preferred embodiments of the invention will be explained in reference to accompanying drawings. In the explanation of the drawings, an identical mark is put on the same element, and a repetition of explanation will be omitted. The dimensional ratios of figures do not always correspond with those of the description.

Figure 1:
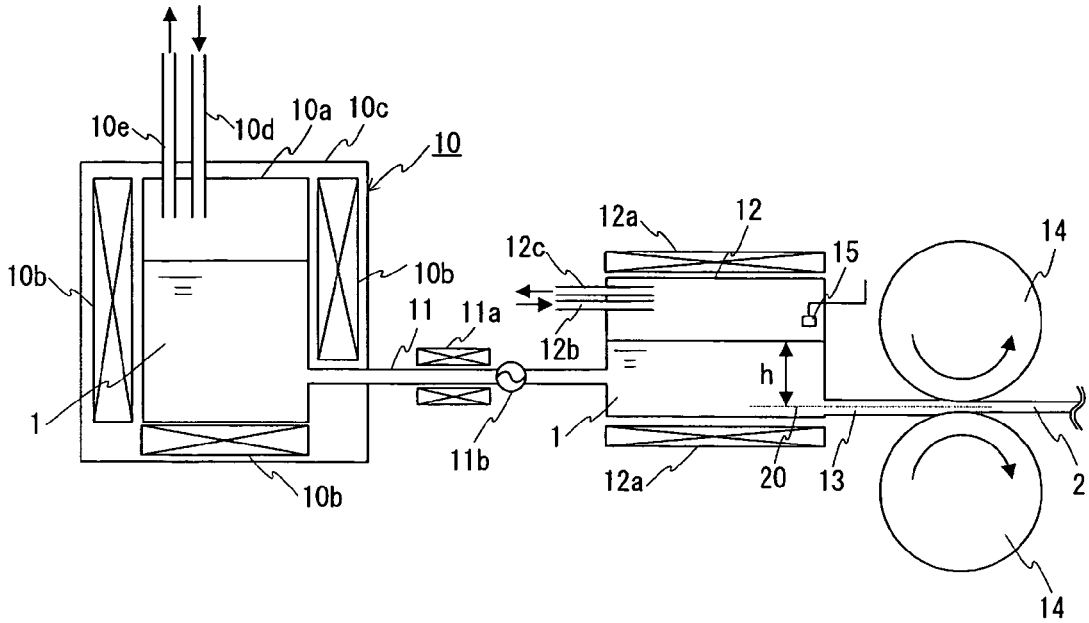
FIG. 1 is a schematic diagram illustrating a structure of a continuous casting system in which molten alloy liquid is supplied by means of the deadweight to a movable mold.

FIG. 1 is a schematic diagram illustrating a structure of a continuous casting system in which molten alloy liquid is supplied by means of the deadweight to a movable mold. This equipment is provided with a melting furnace 10 for melting a metal such as an aluminum alloy or magnesium alloy so as to make it molten alloy liquid 1, a tundish 12 for temporarily storing the molten alloy liquid 1 supplied from the melting furnace 10, a transfer gutter 11, which is disposed between the melting furnace 10 and the tundish 12, for transporting the molten alloy liquid 1 from the melting furnace 10 to the tundish 12, a nozzle 13 for supplying the molten alloy liquid 1 into a space between a pair of rolls 14 from the tundish 12, one pair of the rolls 14 for casting the supplied molten alloy liquid 1 into a cast alloy 2.

The melting furnace 10 is equipped with a crucible 10*a* for melting a metal and storing the molten alloy liquid 1, heaters 10*b*, which are disposed at the outer peripheries of the crucible 10*a*, for maintaining the molten alloy liquid 1 at a constant temperature, and a housing 10*c* for accommodating the crucible 10*a* and the heaters 10*b*. Also, it is equipped with a temperature measuring device (not illustrated in the figure) and a temperature control unit (not illustrated in the figure) so that the temperature of the molten alloy liquid 1 may be controlled with them. In addition, the crucible 10*a* is equipped with a pipe 10*d* for introducing gas, discharge pipe 10*e*, and a gas control unit (not illustrated in the figure) such that control of atmosphere can be made by introducing atmospheric air which contains an inert gas such as argon and a flame retardant gas such as $SF_6$. Also, the crucible 10*a* is equipped with a fin (not illustrated) for stirring the molten alloy liquid 1.

The transfer gutter 11 is structured such that one end thereof is put in the molten alloy liquid 1 and the other end is connected with the tundish 12, and a heater 11*a* is arranged around the outer periphery of the transfer gutter so that the temperature of the molten alloy liquid 1 may not decrease during its transportation.

The tundish 12 is equipped with heaters 12*a* disposed at the outer peripheries thereof, a temperature measuring device (not illustrated in the figure), and a temperature control unit (not illustrated in the figure). The heaters 12*a* are mainly used for heating the tundish 12 at the beginning of operation so that the temperature of the molten alloy liquid 1 that is transported from the melting furnace 10 may be higher than a temperature at which the molten alloy liquid 1 does not solidify. During the stage of stable operation, the heaters 12*a* can be used suitably by seeing the balance between an input temperature from the molten alloy liquid 1 which is transferred from the melting furnace 10 and a discharge temperature released from the tundish 12. Likewise, as in the case of the crucible 10*a*, the tundish 12 also is equipped with a pipe 12*b* for introducing a gas, a discharge pipe 12*c*, and a gas control unit (not illustrated in the figure) so that the atmosphere may be controlled with the gas. Moreover, the tundish 12 also is structured, as in the case of the crucible 10*a*, so that stirring may be done with a fin (not illustrated) for stirring the molten alloy liquid 1.

The nozzle 13, one end of which is fix to the tundish 12, supplies the molten alloy liquid 1 into a space between the rolls 14 from the tip thereof which is arranged at a position on the roll 14 side. A temperature measuring device (not illustrated in the figure) is provided in the vicinity of the tip of the nozzle 13 in order to control the temperature of the molten alloy liquid 1 which is supplied to the tip part. The temperature measuring device is arranged in a manner such that the flow of the molten alloy liquid 1 may not be obstructed. The tundish 12, the nozzle 13, and the rolls 14, are arranged such that the centerline 20 of the gap between the rolls 14 is horizontal so as to cause the molten alloy liquid 1 to travel from the tip of the nozzle 13 into a space between the rolls 14 by the deadweight of the molten alloy liquid 1, and such that the molten alloy liquid is supplied from the tundish 12 horizontally to the space between the rolls 14 through the tip so as to allow a cast alloy 2 to be formed in a horizontal direction. The position of the nozzle 13 is designed to be lower than the level of the surface of the molten alloy liquid 1 in the tundish 12. Particularly, a sensor 15 for detecting the surface level of the molten alloy liquid 1 in the tundish 12 is provided so that adjustment can be made in order to maintain the height h at a given level from the centerline 20 in the gap between the rolls. The sensor 15 is connected with a control unit (not illustrated) so that the flow rate of the molten alloy liquid 1 can be adjusted by controlling a valve 11*b* according to the result of the sensor 15 so as to adjust the pressure of the molten alloy liquid 1 when it is supplied from the tip of the nozzle to the space between the rolls 14.

The movable mold consists of one pair of rolls 14. The rolls 14 are arranged at mutually opposing position with a gap provided between them, and the rolls 14 are structured such that they can turn in mutually opposite direction (e.g., one of the rolls turn in the clockwise direction, and the other roll turns in a counterclockwise direction) by means of a drive mechanism (not illustrated). Particularly, the rolls 14 are arranged such that the centerline 20 in the gap between them may become horizontal. When each roll 14 turns, the molten alloy liquid 1 which is supplied from the tip of the nozzle into the space between the rolls 14 is discharged as a cast alloy 2 as a result of solidification of the molten alloy liquid 1 which has touched the rolls 14. In this example, the direction of the casting becomes a horizontal direction.

Figure 2A:
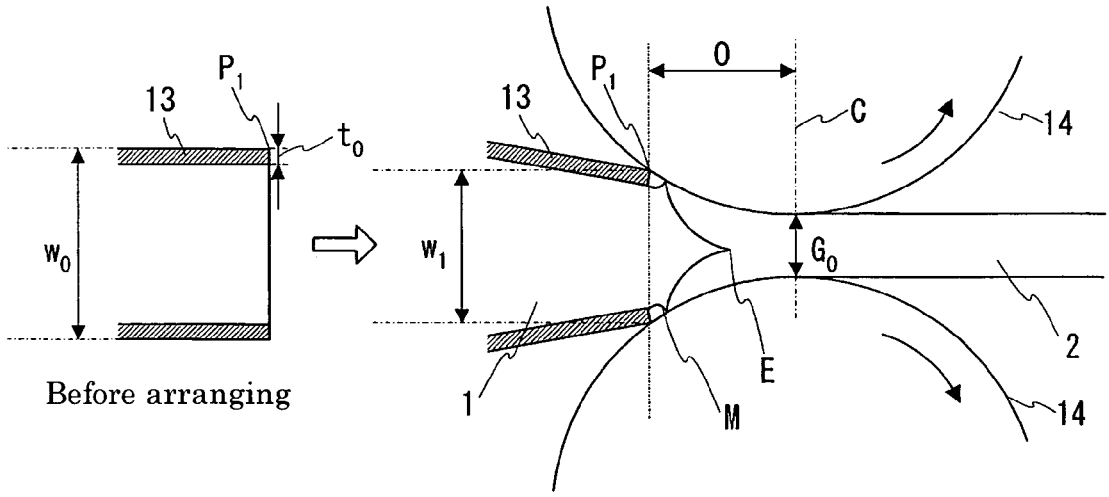
FIG. 2(A) is a schematic diagram which shows a structure of the tip part of a nozzle and in which the tip of the nozzle is arranged in contact with a movable mold prior to casting.
Figure 2B:
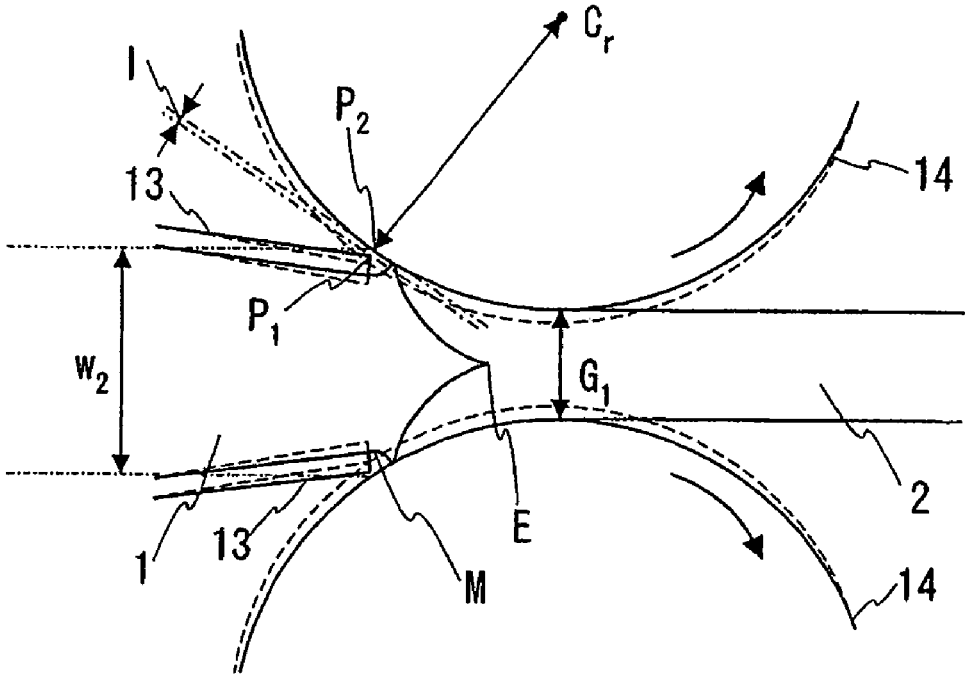
FIG. 2(B) is a schematic diagram which shows a structure of the tip part of the nozzle, illustrating a state in which rolls have moved during casting.

The feature of the present invention is that a material having superior thermal conductivity or a high-strength highly elastic material is used as a material for forming the tip of a nozzle 13. FIGS. 2(A) and 2(B) are schematic diagrams which show a structure of the tip part of a nozzle: FIG. 2(A) shows a state in which the tip of the nozzle is arranged in contact with a movable mold prior to casting, and FIG. 2(B) shows a state in which the rolls have moved during casting. In FIGS. 2(A) and 2(B), the nozzle is shown in a cross-sectional view.

In this example, the entire tip of the nozzle was made of isotropic high density graphite which is superior in terms of thermal conductivity, strength, and elasticity. Using such nozzle makes it possible to arrange in a manner such that the tip $P_1$ of the outer peripheral edge of the nozzle 13 is in contact with the rolls 14 prior to casting as shown in FIG. 2(A). Particularly, in this example, since the tip of the nozzle is made of a material having superior elastic deformability, it is possible to arrange the tip $P_1$ in a state in which it is pressed to the rolls 14 to deform in an elastically deformable range by pressing it onto the rolls 14. By making such arrangement, the interstice between the roll 14 and the tip $P_1$ of the nozzle 13 can be decreased. In this example, the interstice can substantively be eliminated. Thus, even if continuous casting is performed for a long time under the condition of such arrangement, the gap between the rolls 14 and the tip of the nozzle can be maintained narrow for a long time because the tip of the nozzle has high strength and does not wear away easily. Likewise, an interstice I between the tip and the roll 14 can be maintained small even if the roll 14 moves, due to reaction force caused by the solidified material being subjected to draft between the rolls 14 during casting, from the position indicated by a dotted line to the position indicated by a solid line as shown in FIG. 2(B), since the nozzle 13 can deform in an elastically deformable range. More specifically, the interstice I can be maintained within a range of interval equal to or less than 0.8 mm. The interstice I is defined as an interval from the tip $P_1$ of nozzle 13 to an intersection point $P_2$ at which the roll 14 is crossed by a straight line extending in a direction from the tip $P_1$ toward the center Cr of the roll 14 (i.e., radial direction of the roll 14).

Also, the size of the meniscus M can be decreased because of the interstice between the tip $P_1$ and the roll 14 of the nozzle being small as mentioned above.

Moreover, as a result of the tip being made of the material having superior thermal conductivity, it is possible to almost eliminate the variation in the temperature of the molten alloy liquid 1 in a cross-sectional width direction at the tip of nozzle 13 and to achieve uniform solidification of the molten alloy liquid 1 supplied into a space between the rolls 14 from the tip.

The part which has solidified is compressed by the movable mold as a result of casting speed being adjusted so that a solidification-completion point E may exist in a region (which is called "offset O") between the tip and a plane (which is called "mold center C") that passes the central axis of the rolls 14. By this compression, it is possible to vanish or diminish a void which exists in the solidified part. Also, since the draft made by the rolls 14 after the completion of solidification is small, shortcoming such as breakage caused by the draft of the rolls 14 seldom occurs or do not occur at all during casting. Moreover, since the solidified part is held between the rolls 14 still after the last solidification, heat thereof is released through the rolls while the solidified part is inside the closed section defined by the rolls 14. Accordingly, the surface temperature of a cast alloy 2 is already cooled sufficiently at the time when the solidified part is discharged (released) after passing a region where the peripheries of the rolls 14 approach each other most, making the gap between the rolls 14 to be the smallest (minimum gap $G_0$ or $G_1$ region). Thus, the surface quality of the cast alloy does not suffer from the degradation due to rapid oxidation or the like.

The following is a description of examination with respect to the surface quality of cast alloys produced by continuous casting using nozzles, the tips of which are made of various materials having the characteristics shown in Table I and which are installed in the continuous casting system shown in FIG. 1.

TABLE I

| | Materials | | | | |
|---|---|---|---|---|---|
| | Isotropic graphite | C/C composite | Molybdenum | SUS316 | Ceramic fiber sheet |
| Bulk density g/cm$^3$ | 1.8 | 1.5 | 10.2 | 7.9 | 0.7 |
| Tensile strength MPa | 25.5 | 90 | 2000 | 400 | 0.3 |
| Elastic modulus MPa | 9,800 | 110,000 | 327,000 | 200,000 | 1,500 |

TABLE I-continued

| | Materials | | | | |
|---|---|---|---|---|---|
| | Isotropic graphite | C/C composite | Molybdenum | SUS316 | Ceramic fiber sheet |
| Heat conductivity (width direction) W/mK | 120 | 25 | 142 | 16.7 | 0.13 |
| Thickness mm | 0.9 | 0.5 | 0.2 | 0.3 | 0.5 |

EXAMINATION EXAMPLE 1

A continuous casting was performed using pure aluminum as a metal to be melt. In this example, a single board of graphite with 0.9 mm thickness×100 mm width was used as a material for making the tip of a nozzle, and the tip of outer peripheral edge of the nozzle had a size of 7 mm ($W_0$ shown in FIG. 2). The thickness ($t_0$ shown in FIG. 2) of the tip of the nozzle was 0.9 mm. The minimum gap ($G_0$ shown in FIG. 2(A)) between the rolls was 4 mm$^t$. Thus, the nozzle was fixed to a tundish such that the tip of the nozzle might be situated at a position where the gap between the rolls was 6 mm ($W_1$ shown in FIG. 2(A)). That is, prior to casting, the interstice between a roll and the tip of outer peripheral edge of the nozzle was substantially nil (0). The actual interstice examined was equal to or less than 0.3 mm at the greatest situation. Under these conditions, a cast alloy having a width of 100 mm was produced by casting 30 kg of pure aluminum as a molten alloy liquid at a temperature of 750° C.

Then, during casting, the gap ($G_1$ shown in FIG. 2(B)) between the rolls was widened to 4.8 mm$^t$ due to the reaction force, etc. Also, according to such positional movement of the rolls, the interval size ($W_2$ shown in FIG. 2(B)) of the tip of outer peripheral edge of the nozzle was changed. However, during casting, the interstice between the tip of outer peripheral edge of the nozzle and the roll was equal to or less than 0.3 mm, and the tip of the nozzle followed the expansion of the gap between the rolls. Thus, it was confirmed that there was no molten liquid leakage. Also, during casting, the temperature of the molten alloy liquid was examined in a cross-sectional width direction of the tip of the nozzle. In this example, the temperatures at five points arbitrarily selected in a cross-sectional width direction were measured with a temperature measuring device. Then, it was confirmed that the temperatures were almost uniform: the minimum value being 742° C., the maximum value being 743° C. The cast alloy thus obtained had a satisfactory surface quality, exhibiting a glossy surface without any ripple marks or cracks.

EXAMINATION EXAMPLE 2

Figure 3A:
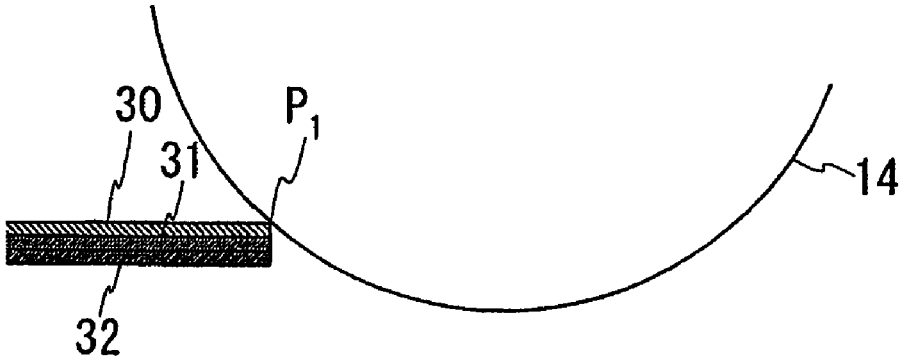
FIG. 3(A) is an enlarged partial cross-sectional view which shows the tip part of a casting nozzle of the present invention.

A continuous casting was performed using a magnesium alloy (AZ31 alloy within the scope of ASTM standard) as a metal to be melt. In this example, a C/C composite board with 0.5 mm thickness×150 mm width, a ceramic fiber sheet with 0.5 mm thickness×150 mm width, and a graphite sheet with 0.6 mm thickness×150 mm width were used as materials for making the tip of a nozzle. As shown in FIG. 3(A), the tip of the nozzle (thickness of the tip: 1.6 mm$^t$) was formed by lamination such that the graphite sheet 30 might be on the roll 14 side, the C/C composite board 32 being disposed on the side to be in contact with a molten alloy liquid while the ceramic fiber sheet 31 was sandwiched therebetween. The interval size of the tip of outer peripheral edge of the nozzle was 7 mm. The minimum gap between the rolls was 3.5 $mm^t$. Thus, the nozzle was fixed to the tundish such that the tip of the nozzle might be situated at the position where the gap between the rolls was 6 mm. That is, prior to casting, the interstice between a roll and the tip of outer peripheral edge of the nozzle was substantially nil. The actual interstice examined was equal to or less than 0.1 mm at the largest situation. Under these conditions, a cast alloy having a width of 300 mm was produced by casting 15 kg of a molten liquid of AZ31 alloy at a temperature of 705° C. In this examination, boron nitride or the like was coated as a mold-releasing agent on the internal surface of the tip of the nozzle.

Then, during casting, the gap between the rolls was widened to 4.2 $mm^t$ due to the reaction force, etc. However, during casting, the interstice between the tip of outer peripheral edge of the nozzle and the roll was equal to or less than 0.3 mm, and the tip of the nozzle followed the expansion of the gap between the rolls. Thus, it was confirmed that there was no molten liquid leakage. Also, during casting, the temperature of the molten alloy liquid was examined in a cross-sectional width direction of the tip of the nozzle. In this example, the temperatures at five points arbitrarily selected in a cross-sectional width direction were measured with a temperature measuring device. Then, it was confirmed that the temperatures were almost uniform: the minimum value being 695° C., the maximum value being 698° C. The cast alloy thus obtained had a satisfactory surface quality, exhibiting a glossy surface without any ripple marks or cracks.

EXAMINATION EXAMPLE 3

Figure 3B:
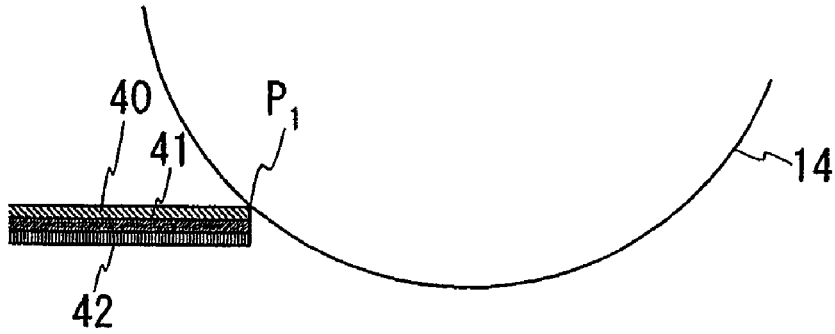
FIG. 3(B) is an enlarged partial cross-sectional view which shows the tip part of a casting nozzle of the present invention.

A continuous casting was performed using a magnesium alloy (AZ91 alloy within the scope of ASTM standard) as a metal to be melt. In this example, a molybdenum board with 0.2 mm thickness×150 mm width, a ceramic fiber sheet with 0.5 mm thickness×150 mm width, and a graphite sheet with 0.2 mm thickness×150 mm width were used as the materials for making the tip of a nozzle. As shown in FIG. 3(B), the tip of the nozzle (thickness of the tip: 0.9 $mm^t$) was formed by lamination such that the graphite sheet 40 might be on the roll 14 side, the molybdenum board 42 being disposed on the side to be in contact with a molten alloy liquid while the ceramic fiber sheet 41 was sandwiched between. The interval size of the tip of outer peripheral edge of the nozzle was 7 mm. The minimum gap between the rolls was 3.5 $mm^t$. Thus, the nozzle was fixed to the tundish such that the tip of the nozzle might be situated at the position where the gap between the rolls was 6 mm. That is, prior to casting, the interstice between a roll and the tip of outer peripheral edge of the nozzle was substantially nil. The actual interstice examined was equal to or less than 0.2 mm at the largest situation. Under these conditions, a cast alloy having a width of 250 mm was produced by casting 15 kg of a molten liquid of AZ91 alloy at a temperature of 670° C.

Then, during casting, the gap between the rolls was widened to 4.2 $mm^t$ due to the reaction force, etc. However, during casting, the interstice between the tip of outer peripheral edge of the nozzle and the roll was equal to or less than 0.3 mm, and the tip of the nozzle followed the expansion of the gap between the rolls. Thus, it was confirmed that there was no molten liquid leakage. Also, during casting, the temperature of the molten alloy liquid was examined in a cross-sectional width direction of the tip of the nozzle. In this example, the temperatures at five points arbitrarily selected in a cross-sectional width direction were measured with a temperature measuring device. Then, it was confirmed that the temperatures were almost uniform: the minimum value being 662° C., the maximum value being 666° C. The cast alloy thus obtained had a satisfactory surface quality, exhibiting a glossy surface without any ripple marks or cracks.

EXAMINATION EXAMPLE 4

Figure 3C:
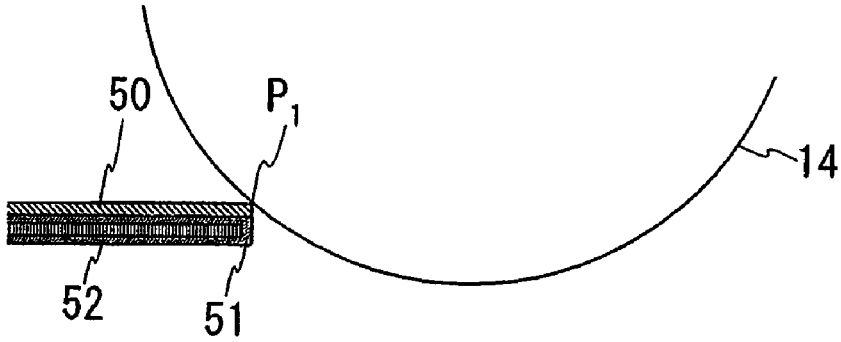
FIG. 3(C) is an enlarged partial cross-sectional view which shows the tip part of a casting nozzle of the present invention.

A continuous casting was performed using an aluminum alloy (JIS 5183 alloy) as a metal to be melt. In this example, ten SUS316 boards each having 0.3 mm thickness×40 mm width, a ceramic fiber sheet with 0.5 mm thickness×409 mm width, and a graphite sheet with 0.5 mm thickness×409 mm width were used as the materials for making the tip of a nozzle. The SUS316 boards were arranged in a width direction such that each interval between the adjacent boards was 1 mm, and the overall width of the boards thus arranged was 409 mm including the intervals. These SUS316 boards were covered altogether with the ceramic fiber sheet, and the graphite sheet was attached on the side to touch with the rolls. Thus, the tip of the nozzle was formed (the thickness of the tip: 1.8 $mm^t$). That is, as shown in FIG. 3(C), the graphite sheet 50 was arranged on the roll 14 side, and the ceramic fiber sheet 51 covering the SUS316 boards 52 was arranged so as to be adjacent to the graphite sheet 50 and to be in contact with the molten alloy liquid. The interval size of the tip of outer peripheral edge of the nozzle was 8 mm. The minimum gap between the rolls was 3.5 $mm^t$. Thus, the nozzle was fixed to the tundish such that the tip of the nozzle might be situated at the position where the gap between the rolls was 6 mm. That is, prior to casting, the interstice between the rolls and the tip of outer peripheral edge of the nozzle was substantially nil. The actual interstice examined was equal to or less than 0.3 mm at the largest situation. Under these conditions, a cast alloy having a width of 300 mm was produced by casting 100 kg of a molten liquid of aluminum 5183-alloy at a temperature of 720° C.

Then, during casting, the gap between the rolls was widened to 4.7 $mm^t$ due to the reaction force, etc. However, during casting, the interstice between the tip of outer peripheral edge of the nozzle and the roll was equal to or less than 0.5 mm, and the tip of the nozzle followed the expansion of the gap between the rolls. Thus, it was confirmed that there was no molten liquid leakage. Also, during casting, the temperature of the molten alloy liquid was examined in a cross-sectional width direction of the tip of the nozzle. In this example, the temperatures at five points arbitrarily selected in a cross-sectional width direction were measured with a temperature measuring device. Then, it was confirmed that the temperatures were almost uniform: the minimum value being 705° C., the maximum value being 709° C. The cast alloy thus obtained had a satisfactory surface quality, exhibiting a glossy surface without any ripple marks or cracks.

INDUSTRIAL APPLICABILITY

The casting nozzle according to the present invention may be used as a member for supplying a molten alloy liquid from a tundish to a movable mold when a continuous casting of aluminum alloy or magnesium alloy is performed. Also, the method of the present invention for manufacturing a cast alloy is most suitable for obtaining a cast alloy having superior surface quality. Moreover, a cast alloy produced by the manufacturing method of the invention can be used as a secondary working material for metal-rolling or the like.

The invention claimed is:

1. A casting nozzle for supplying molten alloy liquid from a tundish to a movable mold comprising a pair of rolls arranged at mutually opposing positions so as to turn in mutually opposite directions, for continuous casting, the casting nozzle being fixed to the tundish for storing the molten liquid of magnesium alloy or aluminum alloy, wherein the casting nozzle comprises a casting nozzle tip having a multilayer structure including a plurality of layers made of different materials comprising first and second heat-conductive layers each made of a material having a heat conductivity equal to or more than 0.2 W/mK, each selected from iron, nickel, titanium, tungsten, molybdenum and alloys including thereof 50% by mass or more, carbon, and a carbon-carbon composite, wherein the first heat-conductive layer is arranged on an inner circumference of the casting nozzle tip which touches the molten alloy liquid, and the second heat-conductive layer is arranged on a roll side, and wherein at least one layer of a ceramic fiber sheet of low-thermal conductivity is sandwiched between the first and second heat-conductive layers.

2. A casting nozzle according to claim 1, wherein the second heat-conductive layer of the casting nozzle tip has a high density layer made of a material having a bulk density of 0.7 g/cm$^3$ or more.

3. A casting nozzle according to claim 1, wherein the second heat-conductive layer of the casting nozzle tip has a high strength layer made of a material having a tensile strength equal to or more than 10 MPa.

4. A casting nozzle according to claim 1, wherein the second heat-conductive layer of the casting nozzle tip has a highly elastic layer made of a material having an elastic modulus equal to or more than 5000 MPa.

5. A casting nozzle according to claim 1, wherein the second heat-conductive layer of the casting nozzle tip has a thickness of 3.0 mm or less.

6. A casting nozzle according to claim 1, wherein the first and second heat-conductive layers are made of a carbon-containing material, including a material made of carbon.

* * * * *